United States Patent [19]

Branovich et al.

[11] Patent Number: 4,929,418

[45] Date of Patent: May 29, 1990

[54] METHOD OF MAKING A CATHODE FROM TUNGSTEN POWDER

[75] Inventors: Louis E. Branovich, Howell; Bernard Smith, Ocean; Gerard L. Freeman, Freehold; Eckart Donald W., Wall, all of N.J.

[73] Assignee: The United States of America as represented by the Secretary of the Army, Washington, D.C.

[21] Appl. No.: 468,335

[22] Filed: Jan. 22, 1990

[51] Int. Cl.[5] ..... B22F 3/26

[52] U.S. Cl. ..... 419/19; 75/232; 75/234; 75/235; 252/644; 264/0.5; 419/27; 419/28; 419/29; 419/33; 419/39; 419/58; 420/1; 445/46; 445/50

[58] Field of Search ..... 419/19, 33, 39, 27, 419/28, 29, 58; 420/1; 264/0.5; 252/644; 75/232, 234, 245; 445/46, 50

[56] References Cited

U.S. PATENT DOCUMENTS

| | | | |
|---|---|---|---|
| 4,594,220 | 6/1986 | Hasken et al. | 419/27 |
| 4,818,480 | 4/1989 | Branovich et al. | 419/27 |
| 4,840,767 | 6/1989 | Branovich et al. | 419/27 |
| 4,873,052 | 10/1989 | Haskin et al. | 419/27 |
| 4,895,699 | 1/1990 | Branovich et al. | 419/27 |

*Primary Examiner*—Stephen J. Lechert, Jr.
*Attorney, Agent, or Firm*—Michael Zelenka; Roy E. Gordon

[57] ABSTRACT

A cathode is made from tungsten powder using as an impregnant the product formed from adding about 1 mole of a member selected from the group consisting of zirconium, zirconium dioxide, hafnium, hafnium dioxide, uranium, uranium dioxide, titanium, and titanium dioxide to about 50 to about 100 moles of a compound selected from the group consisting of $Ba_3Al_2O_6$, $Ba_3WO_6$, and $Ba_4Al_2O_7$.

3 Claims, No Drawings

METHOD OF MAKING A CATHODE FROM TUNGSTEN POWDER

The invention described herein may be manufactured, used, and licensed by or for the Government for governmental purposes without the payment to us of any royalty thereon.

This invention relates in general to a method of making a cathode for operation in microwave devices and in particular to a method of making a cathode for operation in microwave devices from tungsten powder using as an impregnant the product formed from adding about 1 mole of a member selected from the group consisting of zirconium, zirconium dioxide, hafnium, hafnium dioxide, uranium, uranium dioxide, titanium, and titanium dioxide to about 50 to about 100 moles of a compound selected from the group consisting of $Ba_3Al_2O_6$, $Ba_3WO_6$, and $Ba_4Al_2O_7$.

BACKGROUND OF THE INVENTION

Heretofore, cathodes suitable for operation in microwave devices have been made from mixtures of tungsten and expensive metals such as iridium, rhenium, and osmium. The impregnant for these cathodes has also often contained these expensive metals as the metal per se, or the metal included in a compound. This has in effect made the manufacture of a cheaper rugged cathode unobtainable.

SUMMARY OF THE INVENTION

The general object of this invention is to reduce the cost of the method of making a long life high current density cathode. A more particular object of the invention is to provide such a method wherein the resulting cathode will be suitable for use in microwave devices. A still further object of the invention is to provide such a method that does not include the use of expensive metals such as iridium, rhenium, and osmium.

It has now been found that the aforementioned objects can be attained by forming a porous billet from tungsten powder and then impregnating the billet with an impregnant that is the product formed from adding about 1 mole of a member selected from the group consisting of zirconium, zirconium dioxide, hafnium, hafnium dioxide, uranium, uranium dioxide, titanium, and titanium dioxide to about 50 to 100 moles of a compound selected from the group consisting of $Ba_3Al_2O_6$, $Ba_3WO_6$ and $Ba_4Al_2O_7$.

More particularly, according to the invention, a long life high current density cathode suitable for operation in microwave devices is made from tungsten powder by a method including the steps of:

(A) ball milling the tungsten powder for about 8 hours, (B) pressing the ball milled powder into a billet at about 48,000 psi in a die, (C) sintering the billet at about 700° C. to 1325° C. for about thirty minutes in dry hydrogen of less than −100 dewpoint, (D) backfilling the billet with methyl methacrylate,, (E) machining the billet to the desired geometry, (F) removing the methyl methacrylate by dissolution in acetone, (G) thoroughly rinsing in deionized water, methanol and then drying, (H) firing the billet in dry hydrogen at about 700° C. to about 1325° C. for about 15 minutes, (I) impregnating the billet with an impregnant formed from adding about 1 mole of a member selected from the group consisting of zirconium, zirconium dioxide, hafnium, hafnium dioxide, uranium, uranium dioxide, titanium, and titanium dioxide to about 50 to about 100 moles of a compound selected from the group consisting of $Ba_3Al_2O_6$, and $Ba_3WO_6$, and $Ba_4Al_2O_7$ by firing the billet in a dry hydrogen furnace at a temperature at which the impregnant melts for about two minutes, (J) removing the billet from the furnace after the furnace is cooled, and (K) removing any loose pieces of impregnant from the billet.

In the foregoing method, the impregnant is found to melt at about 600° C. to about 1200° C.

DESCRIPTION OF THE PREFERRED EMBODIMENT

A long lived high current density cathode is made in the following manner. Tungsten powder is ball milled for about 8 hours. The ball milled powder is then pressed into a billet at about 48,000 psi in a die and the billet then sintered at 1325° C. for ½ hour in dry hydrogen of less than −100 dewpoint. The billet is then backfilled with methyl methacrylate, the billet machined to the desired geometry, and the methyl methacrylate then removed by dissolution in acetone. The porous billet is then thoroughly rinsed in deionized water, methanol and then dried. The billet is then hydrogen fired at about 1200 ° C. for about 15 minutes. The billet is then impregnated with the impregnant formed by adding about 1 mole of hafnium dioxide to about 50 to about 100 moles of $Ba_3Al_2O_6$ by firing the billet in a hydrogen furnace at about 600° C. to about 1200° C. for about two minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures. The cathode gives current densities of 1 A/cm at 925 ° C. The cathode is also found to be about 1/10th of the cost of a similar cathode wherein the billet is formed from tungsten and iridium powders and wherein $Ba_3A/_2O_6$ is the impregnant.

We wish it to be understood that we do not desire to be limited to the exact details of construction as described for obvious modifications will occur to a person skilled in the art.

What is claimed is:

1. Method of making a cathode for operation in microwave devices from tungsten powder, said method including the steps of:

(A) ball milling the tungsten powder for a bout 8 hours, (B) pressing the ball milled powder into a billet at about 48,000 psi in a die, (C) sintering the billet at about 70° C. to 1325 ° C. for about thirty minutes in dry hydrogen of less than −100 dewpoint, (D) backfilling the billet with methyl methacrylate;

(E) machining the billet to the desired geometry, (F) removing the methyl methacrylate by dissolution in acetone, (G) thoroughly rinsing in deionized water, methanol and then drying, (H) firing the billet in dry hydrogen at about 700° C. to 1325° C. for about 15 minutes, (I) impregnating the billet with an impregnant formed from adding about 1 mole of a member selected from the group consisting of zirconium, zirconium dioxide, hafnium, hafnium dioxide, uranium, uranium dioxide, titanium, and titanium dioxide to about 50 to about 100 moles of a compound selected from the group consisting of $Ba_3Al_2O_6$, $Ba_3WO_6$, and $Ba_4Al_2O_7$ by firing the billet in a dry hydrogen furnace at a temperature at which the impregnant melts for about two minutes, (J) removing the billet from the furnace after the furnace is cooled, and (K) removing any loose pieces of impregnant from the billet.

2. Method according to claim 1 wherein in step I, the billet is fired in a dry hydrogen furnace at about 600° C. to 1200° C. for about two minutes.

3. Method according to claim 2 wherein in Step I, the impregnant is formed from adding about 1 mole of hafnium dioxide to about 50 to 100 moles of $Ba_3Al_2O_6$.

* * * * *